US006376020B1

(12) United States Patent
Tu

(10) Patent No.: US 6,376,020 B1
(45) Date of Patent: Apr. 23, 2002

(54) JET STRIPPING APPARATUS

(75) Inventor: Cat Tu, Balgownie (AU)

(73) Assignee: BHP Steel (JLA) Pty. Ltd.

( * ) Notice: Subject to any disclaimer, the term of this patent is extended or adjusted under 35 U.S.C. 154(b) by 0 days.

(21) Appl. No.: 09/423,617

(22) PCT Filed: May 11, 1998

(86) PCT No.: PCT/AU98/00346

§ 371 Date: Mar. 27, 2000

§ 102(e) Date: Mar. 27, 2000

(87) PCT Pub. No.: WO98/53112

PCT Pub. Date: Nov. 26, 1998

(51) Int. Cl.[7] ..... B05D 3/12
(52) U.S. Cl. ..... 427/348; 118/63
(58) Field of Search ..... 118/63, 21; 427/348; 15/306.1, 309.2

(56) References Cited

U.S. PATENT DOCUMENTS 5,933,931 A * 8/1999 Greenway ..... 118/63

FOREIGN PATENT DOCUMENTS

AU 71753 A 12/1987
WO 8904381 * 5/1989 ..... 118/63

OTHER PUBLICATIONS

JP 55–110769 A Patent Abstracts of Japan, C–32, p. 53 (Shin Nippon Seitetsu KK) Aug. 26, 1980.
JP 62–40350 A Patent Abstracts of Japan, C–436, p. 50 (Sumitomo Metal) Feb. 21, 1987, "Method for Controlling Plating Deposition of Molten".
JP 63–153254 A Patent Abstracts of Japan, C–541, p. 138 (Sumitomo Metal) Jun. 25, 1988, "Method for Preventing Over–Coating of Edge".
JP 1–208441 Patent Abstracts of Japan, C–656, p. 18 (Kawasaki Steel) Aug. 22, 1989, "Gas Wiping Device".
JP 2–38551 A Patent Abstracts of Japan (Nippon Steel) Feb. 7, 1990 "Method and Device for Preventing Overcoating in Hot Dipping" C–712, p. 59 (Sumitomo Metal).
06158261 A Patent Abstracts of Japan (Nippon Steel) "Method for Controlling Coating Weight of Hot Dip Metal Coating".

* cited by examiner

*Primary Examiner*—Laura Edwards
(74) *Attorney, Agent, or Firm*—Miles & Stockbridge P.C.; John C. Kerins

(57) ABSTRACT

A flow diversion device for a gas jet stripping apparatus is used to minimize edge build up when coating a moving strip. The device includes a baffle (17) having a first portion (18) extending longitudinally of the moving strip (4) and adjacent the strip, a second portion (19) extending from the first portion diverging away from the edge of the strip and a gas supply duct (20) communicating with the strip side of the baffle (17) for providing gas to at least the second portion (19) of the baffle. It is preferred that the gas from the duct (20) is supplied with a velocity component in the counter direction of travel of the moving strip.

21 Claims, 5 Drawing Sheets

JET STRIPPING APPARATUS

FIELD OF THE INVENTION

The invention relates to the continuous application of a liquid coating to a substrate strip. The invention is applicable to processes generally, in which a substrate strip is coated with a coating composition, but was devised primarily for use in the continuous galvanising of steel strip (wherein the liquid coating is molten zinc) or the continuous coating of steel strip with other liquid coatings such as molten aluminium zinc alloys or polymeric paint compositions.

BACKGROUND OF THE INVENTION

It is commonplace in such processes firstly to apply an over thick layer of liquid coating material to the strip at a coating station and then strip surplus material from the over thick layer to the required thickness for the finished coat. The reduction of the over thick layer is generally carried out using a gas jet stripping apparatus.

Gas jet stripping apparatus of the prior art includes two elongated nozzles disposed one on either side of the strip's pass line, which direct sheetlike jets of gas against the respective sides of the thickly coated strip. The two nozzles extend transversely of the strip at right angles to the direction of strip travel. Each gas jet impinges normally or at a certain angle sometimes as large as 30° to the strip, and splits into two gas streams flowing over the surface of the strip. One such stream flows in the direction of strip travel and the other flows in the opposite direction. Thus, one of the streams flow counter to the oncoming over thick layer and blows material from the layer back upon itself. The net effect is to prevent all but a thin layer of coating material in close adherence to the substrate strip from travelling with the strip past the nozzles.

For any particular installation, each nozzle is at least as long as the maximum width of strip that may be processed by the installation. Thus, whenever strips of lesser width are being processed, the nozzles extend beyond the edges of the strip. It follows that, beyond the edges of the strip, the end portions of the gas jets meet in opposition, producing a turbulent flow pattern adjacent to the strip edges.

A major problem of the traditional gas jet stripping apparatus described above was that the margins of the finished coating adjacent the longitudinal edges of the strip were somewhat thicker than the main part of the coating. This is known as edge build up and is thought to be due to two causes:

(I) The original application of the over thick layer of coating material applies coating material not only to the wide side faces of the strip but also to the narrow edge faces. Thus, there is a slightly greater amount of surplus material to be held back by the counter flowing gas stream at the strip edges than there is remote from the edges, and this leads to the slightly greater finished coating thickness near the edges.

(ii) The aforesaid turbulent flow pattern reduces the effectiveness of the counter flowing gas stream near the strip edges.

Therefore it has been previously proposed to modify the traditional gas jet stripping apparatus by the addition of a baffle to a plate adjacent each of the strip edges and disposed between the nozzles of the opposed gas jets. The courier plate extends from the vicinity of the strip edge to the maximum strip width and is disposed between the counter flowing gas stream beyond the strip edges.

Each such baffle is a rigid flanged edge having a first portion which extends longitudinally of the strip adjacent a longitudinal edge of the strip, and a second portion, being an extension of the first portion, which diverges away from the edge of the strip in the upstream direction of the strip. The first portion of the flanged edge is spaced a small distance from the longitudinal edge of the strip to allow an unhindered passage of the strip past the baffle.

The effect of the baffle is to contain the stripping counter flowing gas stream (and shield it from the above mentioned turbulence) until such time as the stripping gas stream reaches the second portion of the baffle. The stripping gas stream adjacent the baffle then tends to follow the diverging second portion of the baffle and thus sweeps across the edge of the strip. In so doing it carries coating material from the margin across the edge and discharges it from the strip as free droplets, so reducing the marginal coating thickness.

It has been found that such prior known gas flow control baffles, at least as applied to strips travelling vertically upwardly from a coating station, become less effective at slow strip speeds. This is because at low strip speeds there is less coating material to be dragged up by the moving strip, and the gas pressure supply to the nozzle has to be reduced to ensure that a sufficiently thick final coating is achieved. It is thought that this reduces the tendency of the gas flow to follow the diverging baffle portion with consequent reduction in the discharge from the margin of the over thick coating.

DISCLOSURE OF THE INVENTION

The object of the present invention is to alleviate the above deficiency.

Accordingly, the invention provides a gas jet stripping apparatus for reducing the thickness of the liquid coating on a moving strip including a pair of opposed gas jet stripping nozzles defining a stripping region, and a flow diversion device for positioning between said nozzles in said jet stripping region and adjacent said moving strip, said flow diversion device including a baffle having a first portion extending longitudinally of the strip adjacent the longitudinal edge of the strip, a second portion diverging away from the edge of the strip, and a gas supply duct communicating with the strip side of the baffle for providing gas to at least the second portion of the baffle.

It is thought that by supplying supplementary gas adjacent the baffle and directed over at least the strip side of the second portion of the baffle, less counter flowing gas stream at the strip edges and edge build up is greatly reduced.

In a preferred form of the invention, the gas is supplied to the strip side of the baffle in proximity to the junction of the first and second portions of the baffle having a velocity component in a direction which is counter to the direction of travel of the strip.

The baffle may be provided with at least one injection outlet and the gas from the at least one injection outlet is directed towards the strip at an angle within the range of +30° to −30° to the longitudinal edge of the strip, preferably +20° to −20° and most preferably within the range of +15° to −5°, a positive sign denoting injection toward the strip edge (in the direction of the strip center) and a negative sign indicating gas injection in a direction away from the strip.

The gas supply duct may supply gas to a gas plenum or a plurality of plenum which in turn supply a plurality of injection outlets on the strip side of the edge baffle.

In another aspect of the invention there is provided a flow diversion for a jet gas stripping apparatus, said device including a baffle having a first portion extending longitudinally of the strip adjacent the longitudinal edge of the moving strip, a second portion diverging away from the edge of the strip, and a gas supply duct communicating with the strip side of the baffle for providing gas to at least the second portion of the strip side of the baffle.

In a further aspect of the invention there is provided a method of reducing the edge build up in the coating process of a moving strip.

Figure 1:
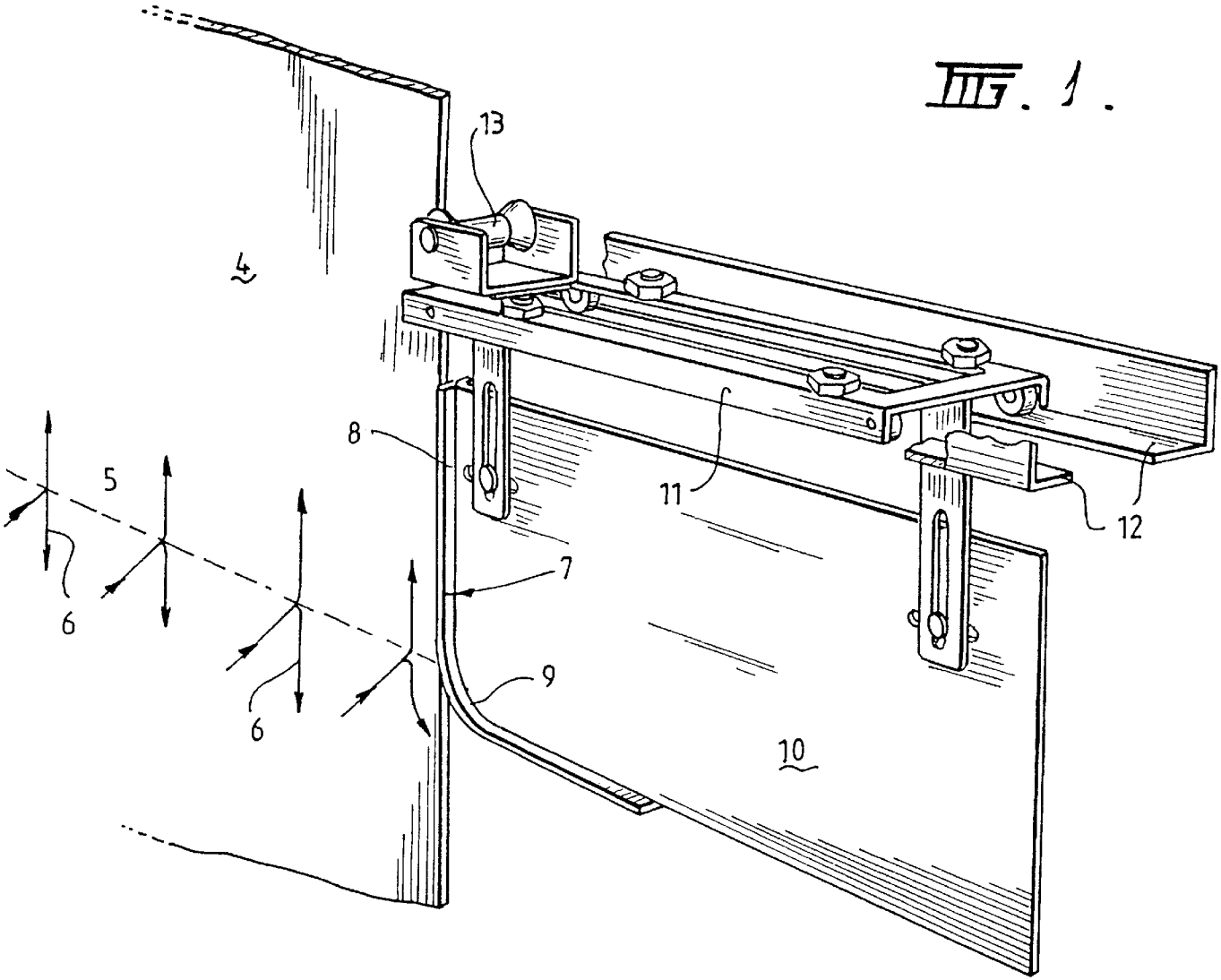
FIG. 1 is a perspective view of a prior art gas flow control device.

The prior art gas flow control device of FIG. 1 is typical of those found in a steel strip galvanising or similar metal coating line. The strip 4 being coated is shown rising vertically as from a hot dip coating pot (not shown). On leaving the pot the strip is covered with an over thick layer of a molten metal or metal alloy coating. Two sheet like stripping jets of gas, for example air, steam or nitrogen, are directed respectively at the sides of the strip 4 by elongated nozzles (not shown) extending transversely of the sheet on opposite sides thereof. The jet on the side of the sheet that is visible in the Figure impinges on that side along the broken line marked 5 to define a stripping region and divides into two gas streams, as indicated by the arrows in the Figure. One stream is directed upwardly or in the direction of the moving strip and the other, referred to herein as the counter flowing gas stream and referenced 6, is directed downwardly or in the counter direction of strip movement. The counter flowing gas stream 6 is responsible for the stripping effect by blowing coating material downwardly or in the counter direction towards the dipping pot. The stripping jets directed at the hidden side of the sheet 4 are in register with the jets shown in FIG. 1.

The prior art flow control device shown in FIG. 1 includes a baffle 7, being a metal strap with a width dimension perpendicular to the plane of the strip 4 and having a first portion 8 extending longitudinally of the adjacent edge of the strip 4 and a second portion 9, being an extension of the first portion 8, of a curved or arcuate shape diverging from the edge of the strip 4 in the counter direction of strip movement.

The baffle 7 may be supported by a carrier plate 10 lying substantially in the plane of the strip 4 and suspended from a carriage 11 able to move along rails 12 defining a travel path for the carriage 11 that also lies in the plane of the strip 4.

The carriage is loaded towards the strip 4 by any suitable means (not shown). The operating position of the carriage is thus determined by a buffer roller 13 on the carriage 11 in contact with the edge of the strip 4. The position of the roller 13 is such that when the carriage is in its operating position, the first portion 8 of the baffle 7 is just clear of the edge of the strip 4.

The carrier plate 10 not only supports the baffle 7, but also acts as an extension of the strip 4 between the stripping jet portions lying outboard of the strip edges when the width of the strip is less than the span of the nozzles. This markedly reduces the noise that is otherwise produced by the meeting of the two opposed jets.

It will be appreciated that gas flow control device which is the mirror image of those illustrated and described above may be provided at the opposite edge of the strip 4 not shown in FIG. 1.

Figure 2:
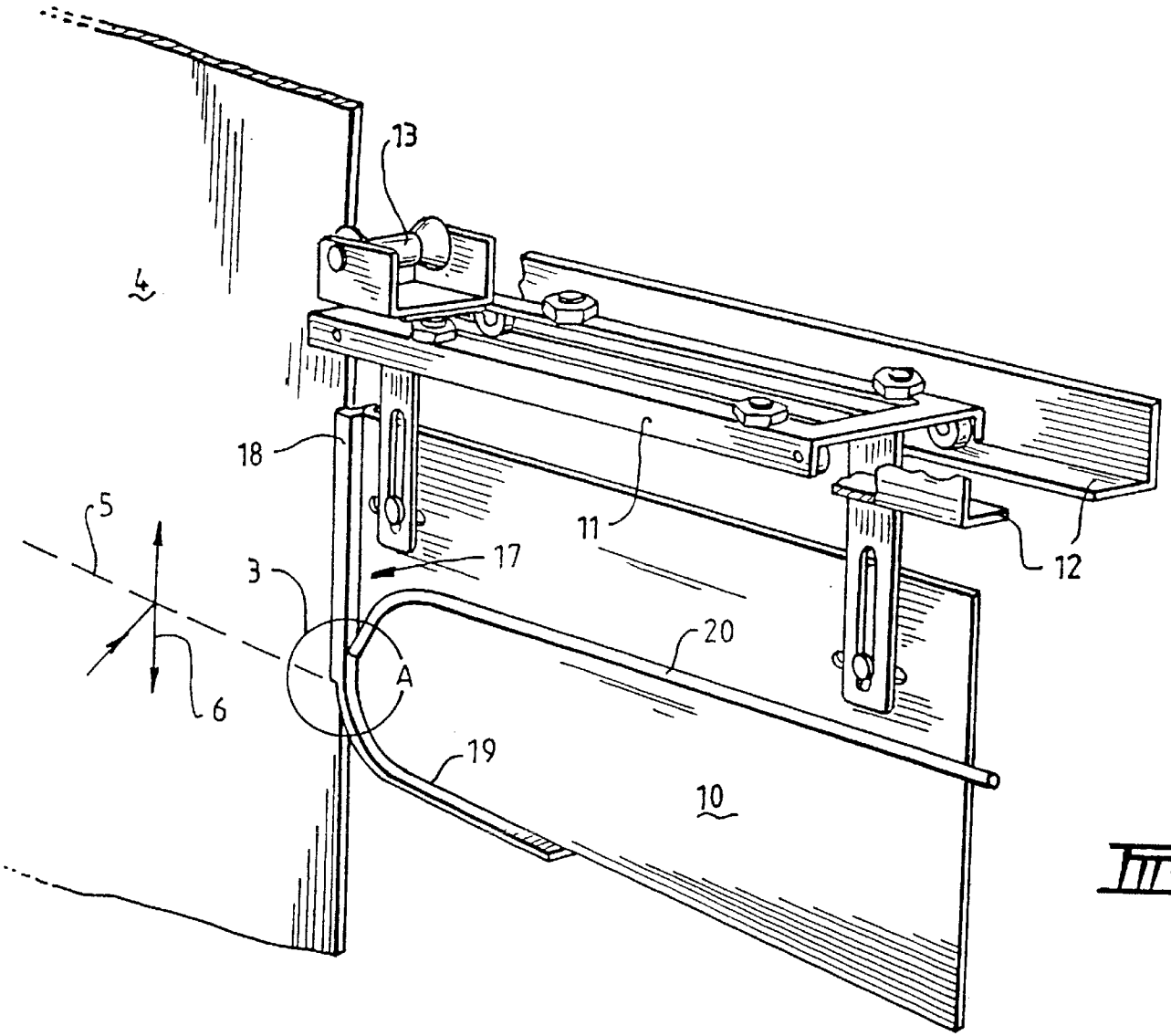
FIG. 2 is a perspective view of an embodiment of a gas flow control device according to the present invention.
Figure 3:
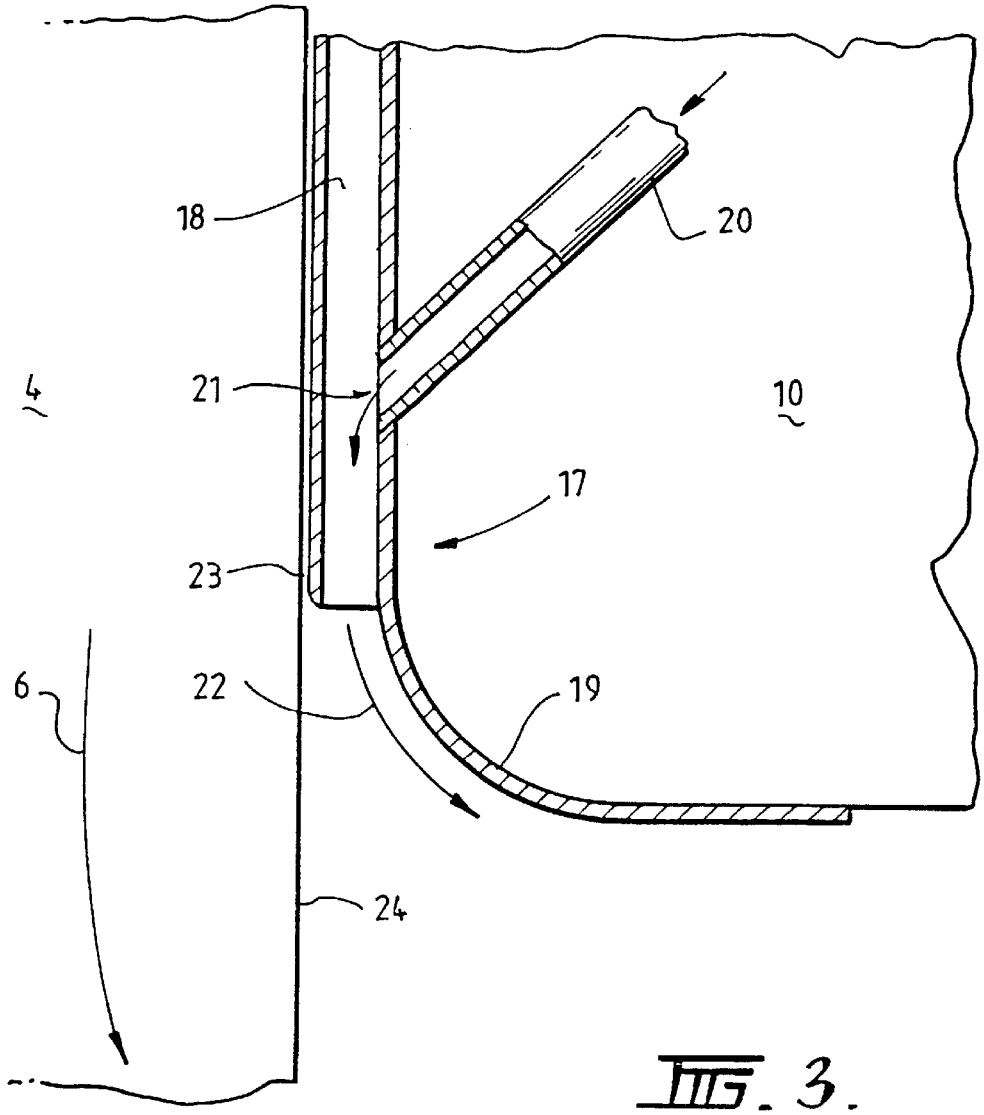
FIG. 3 is an enlarged sectional view of region A of FIG. 2.

The gas flow control device according to the embodiment of the invention illustrated by FIGS. 2 and 3 differs from the embodiment of the prior art described above by a modification of the baffle to provide for the supply of supplementary gas to the strip side of the baffle. Those components not directly associated with the supply of supplementary gas may be the same as the corresponding components in the prior art embodiment. Thus those common components are referenced with numerals corresponding to those in FIG. 1 and are not further described below.

There is shown in FIGS. 2 and 3, a baffle 17 having a first portion 18 that is in the form of an open ended length of a hollow rectangular section, and a second portion 19 that is an extension of that wall of the first portion 18 which is more remote from the strip 4.

A supply tube 20 lies against the carrier plate 10, preferably at a position outside the area of the plate impinged upon by the stripping jets, adapted at one end by conventional connector means (not shown) for connection to a heat resistant supply hose, for example a short braided SS hose, connected in turn to a pliable plastics hose or the like extending to a remote pressurised gas source, and opening at its other end 21 into the hollow interior of the first baffle portion 18. Thus, gas from the remote source may be fed into the first portion 18 for release from an outlet 23 as a stream 22 of supplementary gas. It is believed that a proportion of the gas exiting outlet 23 follows the contour of the diverging second portion of the baffle reducing the air pressure near the strip edge 24 and entraining some of the counter flowing gas stream 6 with it. Be that as it may, it has been found that the supply of the supplementary gas at this point augments the stripping effect of the gas stream on the margin of the coating.

In one exemplary embodiment of the invention of FIGS. 2 and 3 the height of the baffle portion 18 may be any suitable dimension typically up to 21 mm with a wall thickness of about 0.5 mm, and the cross section of the hollow interior through which the supplementary gas stream flows is about 20×1 mm.

In this instance the gas pressure of the supply source may be at or above 200 kPa above ambient pressure, with a conventional pressure regulator interposed between it and the supply tube to enable appropriate control setting of the rate of gas flow from the first baffle portion 18.

With the supply tube angled downwardly, as shown in the configuration of FIG. 3 at its entry to the baffle portion 18, there is no need to plug the top open end of the baffle, but in other embodiments wherein the tube is not so shaped and is, for example, perpendicular to the baffle it may be desirable so to do.

In view of the increased thickness of the upper portion 18 of the baffle, it is desirable to chamfer its vertical edges so that the vertical corner line nearer to the strip 4 is sharp and thereby better separates the portion of the jet stream playing onto the strip 4 from any end parts playing onto the carrier plate 10.

In the embodiment shown in FIG. 3, the gas is directed from gas outlet 23 initially at an angle $\alpha=0°$ to the longitudinal direction of the strip.

As shown in the other embodiments of the invention, it is within the scope of the invention for the angle $\alpha$ of the gas to be within the range of +30° to −30° relative to the longitudinal direction of the first portion of the baffle. In preferred forms of the invention injection angle of the gas is within the range of +20° to −20° and most preferably +15° to −5° relative to the longitudinal direction of the strip. In most instances of operation, the longitudinal direction of the strip is aligned vertically.

Figure 4:
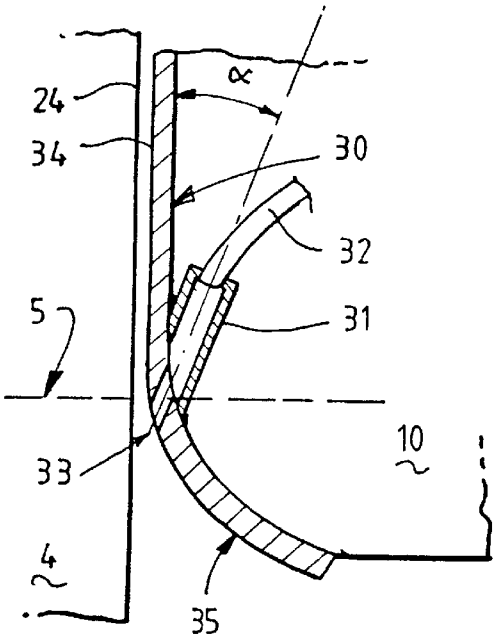
FIG. 4 is a sectional view similar to FIG. 3 of a second embodiment of the invention.

In the embodiment of FIG. 4, the baffle 30 is provided with a plenum chamber 31 in which the gas supply duct 32 is connected. The plenum 31 has at least one injection outlet 33 for supplying gas from the supply duct to the strip side of the baffle 30. The sides of the plenum are sealed to ensure all of the gas entering the plenum exits via the gas outlets. The outlet is positioned in proximity to where the first portion of the baffle extends to become the diverging curved second portion 35 of the baffle and gas is directed from the outlet at an angle $\alpha$ to the first portion 34 of the baffle in a direction which is generally counter to the direction of travel of the strip 4. The injection angle $\alpha$ may be as much as 30° thus still providing a velocity component in the counter direction.

Figure 5:
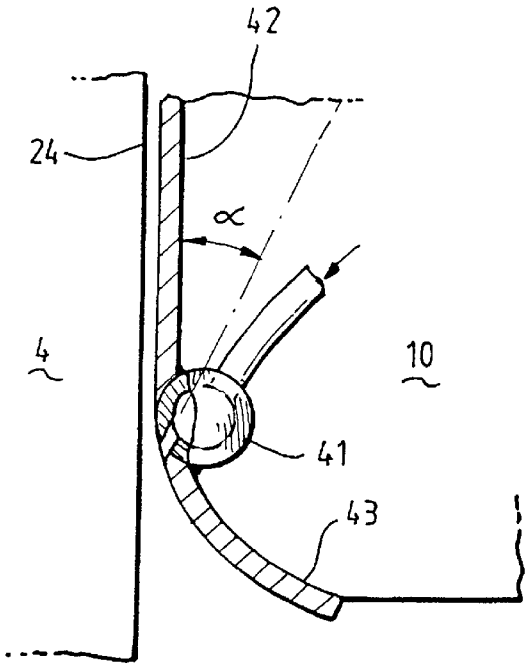
FIG. 5 is a sectional view similar to FIG. 3 of a third embodiment of the invention.

The embodiment of FIG. 5 depicts a cylindrical plenum chamber 41 supplying gas to the strip side of the baffle in proximity to the connection between the first portion 42 and the curved diverging section 43. The injection angle $\alpha$ of the gas is shown as a positive angle i.e. towards the strip. The sides of the plenum 41 are sealed to ensure all of the gas exits by the outlets in the direction intended.

Figure 6:
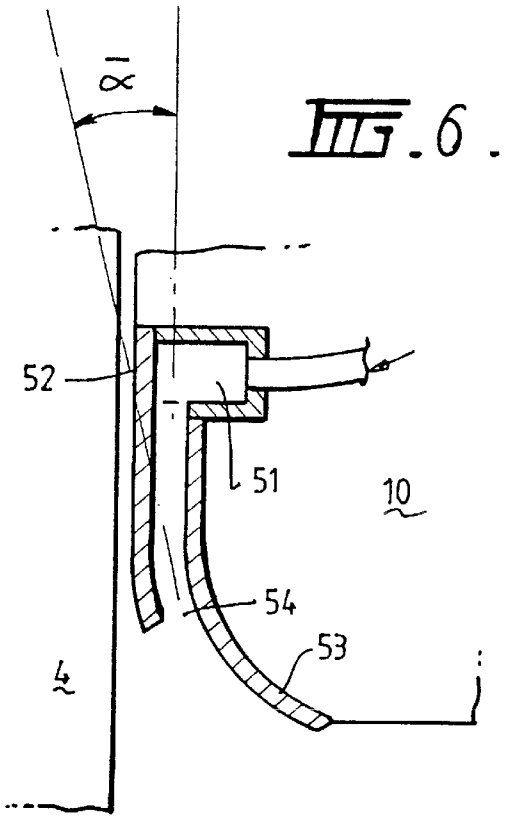
FIG. 6 is a sectional view similar to FIG. 3 of a fourth embodiment of the invention.

In the embodiment of FIG. 6, the plenum chamber 51 is shown integrated into the wall of the baffle. In this embodiment the strip side of the plenum forms part of the first portion 52 of the baffle and the side of the plenum 51 furtherest from the strip connects to the second portion 53 of the baffle diverging away from the strip. The sides of the plenum are sealed. In this embodiment the injection angle $\alpha$ of gas leaving outlet 54 is away from the strip and can be represented as a negative injection angle.

By simple adaptation, the embodiments of FIGS. 3, 4 and 5 can similarly be modified to direct the injection gas away from the strip edge 24 at a negative injection angle. Similarly, the gas injection angle in FIG. 6 can be made for positive injection ie. towards the strip. It would be appreciated by those skilled in the art that in all circumstances, the injection of gas is generally in the counter direction of travel of the moving strip 4 and that the gas stream has a velocity component in the counter direction of travel of the strip.

Figure 7:
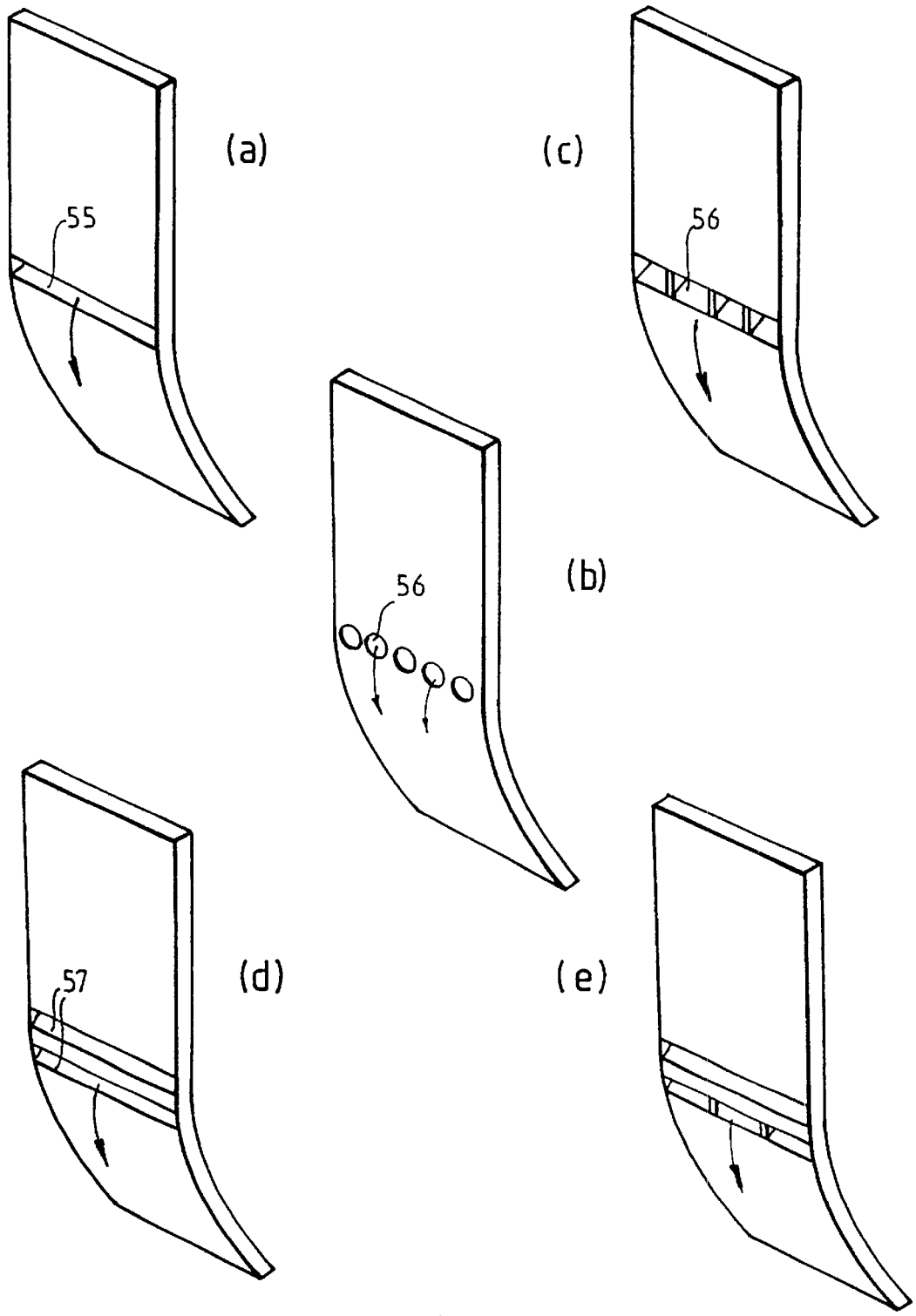
FIGS. 7(*a*)–7(*e*) are alternative arrangements and shapes of gas outlets in accordance with the invention.

As shown in FIG. 7(*a*), the injection outlet 55 may be a slit having a typical width of from about 0.5 mm to 5 mm and extend substantially the width of the baffle. Alternatively, the slit may consist of multiple outlets 56 aligned across the baffle, outlets 57 spaced along the baffle or a combination of both arrangements (see FIGS. 7(*b*) to 7(*e*)). The choice of arrangement is dependent on such considerations as the size of the jet stripping operation, the volume of gas being injected and the pressure of the gas supply.

There are some distinct advantages to using multiple injection outlets. By increasing the number of injection outlets, the volumetric flow of gas can be increased without increasing the velocity of the gas passing through the nozzles thereby maintaining or reducing the noise created by the gas leaving the nozzles. Additionally, the use of multiple outlets provides better gas flow direction control. Other advantages of using multiple injection outlets would be apparent to those of ordinary skill in the art.

While the number of injection outlets is dependent on the jet gas stripping operation it is essential that the gas is delivered to the strip side of the baffle with a directional component which is counter to the direction or movement of the strip. In this way the gas which enters the region between the strip and diverging curved portion of the baffle, comes under the aerodynamic influence of the diverging curved baffle portion drawing excess coating material away from the edges of the strip. In this way the aerodynamic influence of the diverging curved portion of the baffle is greatly enhanced.

In prior art gas jet stripping apparatus, it is desirable for the baffle and carrier plate to be as close as possible to the moving strip in an attempt to minimise the edge effects. However, the applicant has found that by providing a stream of gas with a directional velocity component counter to the direction of movement of the strip into the region between the moving strip and the diverging curved section of the baffle, the operation of the baffle can be greatly enhanced and a uniform coating can be formed on the strip right up to the strip edge. Furthermore, it has been found that a baffle in accordance with the present invention can be positioned up to about 400 mm from the moving strip edge at a distance more than three times that normally used in prior art apparatus and still provide superior minimisation of the edge build up over the prior art apparatus.

What is claimed is:

1. A method of reducing edge build up on a coated moving strip in a gas jet stripping apparatus comprising a flow diversion device including a baffle having a first portion extending longitudinally of the strip adjacent a longitudinal edge of the moving strip and a second portion diverging away from the edge of the strip and a gas supply duct supplying gas to the strip side of said baffle, said method comprising the steps of positioning said flow diversion device adjacent the moving strip and directing gas from said gas supply duct along at least the second portion of the strip side of the baffle.

2. A jet gas stripping apparatus for reducing a thickness of a liquid coating on a moving strip comprising a pair of opposed gas jet stripping nozzles defining a stripping region, and a flow diversion device for positioning between said nozzles in said stripping region and adjacent said moving strip, said flow diversion device including a baffle having a first portion extending longitudinally of the strip adjacent a longitudinal edge of the strip, a second portion diverging away from the edge of the strip, and a gas supply duct communicating with the strip side of the baffle for providing gas to at least the second portion of the baffle.

3. The jet gas stripping apparatus of claim 2 wherein the gas supply duct communicates with the strip side of the baffle in proximity to a junction of the first and second portions of the baffle.

4. The jet gas stripping apparatus of claim 2 wherein the baffle is provided with at least one injection outlet, the gas supply duct communicating with said injection outlet.

5. The jet gas stripping apparatus of claim 2 wherein the gas from the injection outlet is directed counter to the direction of travel of the strip on the strip side of the baffle.

6. The jet gas stripping apparatus according to claim 5 wherein the gas from the at least one injection outlet is directed towards the strip at an angle within the range of +30° to −30° from the direction of travel of the strip.

7. The jet gas stripping apparatus according to claim 5 wherein the gas from the at least one injection outlet is directed towards the strip at an angle within the range of +20° to −20° from the direction of travel of the strip.

8. The jet gas stripping apparatus according to claim 5 wherein the gas from the at least one injection outlet is directed towards the strip at an angle within the range of +15° to −5° from the direction of travel of the strip.

9. The jet gas stripping apparatus according to claim 2 wherein the gas supply duct supplies gas to a gas plenum, the gas plenum communicating with at least one gas outlet.

10. The jet gas stripping apparatus according to claim 9 wherein a plurality of injection outlets are provided, each outlet being supplied by gas from said gas plenum.

11. The jet gas stripping apparatus according to claim 4 wherein the at least one injection outlet has a shape selected from the group consisting of a round nozzle, a square hole and a rectangular hole.

12. A flow diversion device for positioning adjacent a moving strip in a jet gas stripping apparatus, said device comprising a baffle having a first portion extending longitudinally of the strip adjacent a longitudinal edge of the moving strip, a second portion diverging away from the edge of the strip, and a gas supply duct communicating with the strip side of the baffle for providing gas to at least the second portion of the strip side of the baffle.

13. The flow diversion device according to claim 12 wherein the gas supply duct communicates with the strip side of the baffle in proximity to the junction of the first and second portions of the baffle.

14. The flow diversion device according to claim 12 wherein the baffle is provided with at least one injection outlet, the gas supply duct communicating with said at least one injection outlet.

15. The flow diversion device according to claim 14 wherein the gas from the at least one injection outlet is directed counter to the direction of travel of the strip.

16. The flow diversion device according to claim 14 wherein the gas from the at least one injection outlet is directed towards the strip at an angle within the range of +30° to −30° from the longitudinal edge of the strip.

17. The flow diversion device according to claim 14 wherein the gas from the at least one injection outlet is directed towards the strip at an angle within the range of +20° to −20° from the longitudinal edge of the strip.

18. The flow diversion device according to claim 14 wherein the gas from the at least one injection outlet is directed towards the strip at an angle within the range of +15° to −5° from the longitudinal edge of the strip.

19. The flow diversion device according to claim 14 wherein the gas supply duct supplies gas to a gas plenum, the gas plenum communicating with the at least one injection outlet.

20. The flow diversion device according to claim 19 wherein a plurality of injection outlets are provided, each outlet being supplied by said gas plenum.

21. The flow diversion device according to claim 14 wherein the at least one injection outlet has a shape selected from the group consisting of a round nozzle, a square opening or a rectangular opening.

* * * * *

UNITED STATES PATENT AND TRADEMARK OFFICE

CERTIFICATE OF CORRECTION

PATENT NO. : 6,376,020 B1
DATED : April 23, 2002
INVENTOR(S) : Cat Tu

It is certified that error appears in the above-identified patent and that said Letters Patent is hereby corrected as shown below:

Title page,
The following is to be inserted:
-- [30] Foreign Application Priority Data
May 19, 1997 (AU)…….PO6681 --

Signed and Sealed this

Third Day of September, 2002

*Attest:*

*Attesting Officer*

JAMES E. ROGAN
*Director of the United States Patent and Trademark Office*